US007604499B2

(12) United States Patent
Sunaga

(10) Patent No.: US 7,604,499 B2
(45) Date of Patent: Oct. 20, 2009

(54) ELECTRICAL CONNECTOR

(75) Inventor: Siro Sunaga, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/155,519

(22) Filed: Jun. 5, 2008

(65) Prior Publication Data

US 2008/0311780 A1 Dec. 18, 2008

(30) Foreign Application Priority Data

Jun. 12, 2007 (JP) ..... 2007-154690

(51) Int. Cl.
*H01R 12/24* (2006.01)

(52) U.S. Cl. ..... 439/495

(58) Field of Classification Search ..... 439/495, 439/492, 260, 345, 493, 494, 496–499
See application file for complete search history.

(56) References Cited

U.S. PATENT DOCUMENTS 7,255,584 B2 * 8/2007 Takashita ..... 439/260
7,300,304 B1 * 11/2007 Takashita ..... 439/495
2007/0202736 A1 * 8/2007 Takashita ..... 439/495

FOREIGN PATENT DOCUMENTS

JP 2004-178958 6/2004
JP 2007-048499 2/2007

* cited by examiner

*Primary Examiner*—Alexander Gilman
(74) *Attorney, Agent, or Firm*—Kubotera & Associates, LLC

(57) ABSTRACT

An electrical connector to be connected to a flat conductive member includes a housing; and a terminal disposed in the housing. The terminal includes a fixed arm portion, a movable arm portion, and a connecting portion connecting the fixed arm portion and the movable arm portion. The movable arm portion includes a pressing portion on one end portion thereof and a pressed portion on the other end portion thereof. The electrical connector further includes a pressing member disposed to be movable between an open position to a closed position for pressing the pressed portion; and a regulating portion disposed on at least one of the housing and the fixed arm portion for regulating the pressing member at the closed position from moving toward the connecting portion.

7 Claims, 4 Drawing Sheets

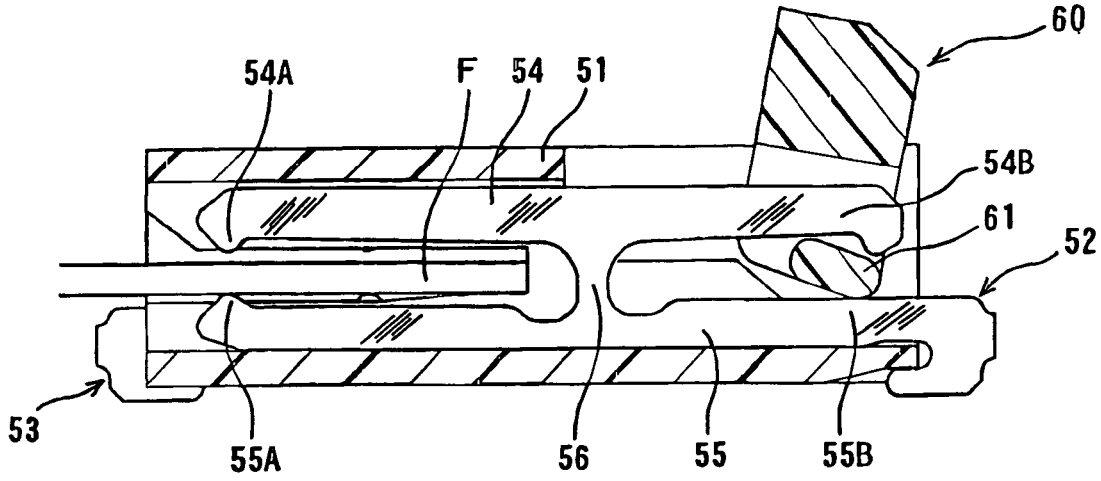
FIG. 4 (A) PRIOR ART
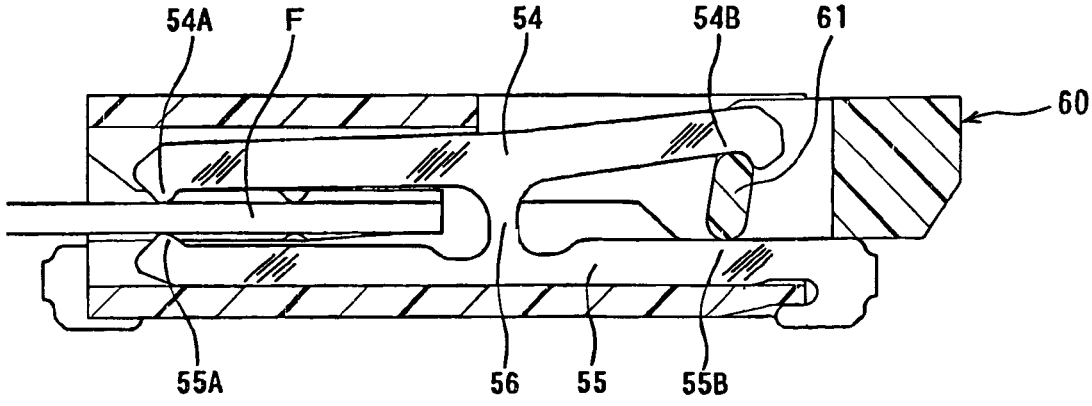
FIG. 4 (B) PRIOR ART

ELECTRICAL CONNECTOR

BACKGROUND OF THE INVENTION AND RELATED ART STATEMENT

The present invention relates to an electrical connector for a flat conductive member.

As an electrical connector for a flat conductive member, a connector having a terminal has been known. The terminal is shaped of a metal sheet so that a planar surface of the metal sheet is maintained. A plurality of the terminals is arranged so that the planar surfaces are parallel to each other. Further, a pressing portion of the terminal is displaced in the planar surface so that a flat conductive member is pressed to fit into a contact portion of the terminal.

In a connector of this type disclosed in Patent Reference, as shown in FIG. 4(A), two types of terminals, terminals 52 and 53, are arranged in a housing 51. As each of the terminals 52 and 53 has a similar relationship with a pressing member, only the terminal 52 will be explained in the following description. Patent Reference: Japanese Patent Publication No. 2004-178958

The terminal 52 has a fixed arm portion 55 and a movable arm portion 54. A connecting portion 56 connects the fixed arm portion 55 and the movable arm portion 54 as a single member in a middle portion. The fixed arm portion 55 and the movable arm portion 54 are substantially parallel to each other. The movable arm portion 54 is situated in an upper portion. The movable arm portion 54 has a pressing portion 54A on one end and a pressed portion 54B on the other end.

The pressing portion 54A presses a flat conductive member F. The pressed portion 54B receives pressure from a cam portion 61 of a pressing member 60. The pressing member 60 extends over a plurality of terminal arrangement ranges. The pressing member 60 has shaft portions (not shown) on both ends in a terminal arrangement direction (direction perpendicular to a sheet surface).

The housing 51 supports the shaft portion to be freely rotatable. The cam portion 61 is rotatably operated around the shaft portion to press the pressed portion 54B of the terminal 52. The cam portion 61 is guided to rotate between the pressed portion 54B of the movable arm portion 54 and a guide portion 55B of the fixed arm portion 55 of the terminal 52. The pressed portion 54B is formed on an end portion of the movable arm portion 54. The guide portion 55B is formed on an end portion of the fixed arm portion 55. Each of the end portions is substantially linear in a direction to which each of the arm portions extends.

In the connector disclosed in Patent Reference, when the pressing member 60 is rotated from an open position shown in FIG. 4(A) to a closed position shown in FIG. 4(B), the pressed portion 54B receives a force from the cam portion 61 to be displaced. Accordingly, the movable arm portion 54 makes an angular movement as a lever taking the connecting portion 56 as a pivot to be displaced in a direction in which the pressing portion 54A presses the flat conductive member F. The flat conductive member F and a contact portion 55A of the fixed arm portion 55 are electrically connected with contact pressure.

In the connector disclosed in Patent Reference, the pressing member 60 is supported so that the rotation center is in a specific position only in a shaft portion that protrudes from an end portion in a terminal arrangement direction. The terminal arrangement range is situated between the shaft portions. The cam portion 61 of the pressing member 60 is supported between the movable arm portion 54 and the fixed arm portion 55 of the terminal 52 in a top-to-bottom direction in the terminal arrangement range. The cam portion 61 of the pressing member 60 is not supported or regulated in a longitudinal direction of the arm portions or a transverse direction.

The terminal of the connector of this type is made to be flat. Accordingly, a pitch between the terminals can be small, which enables to provide many terminals. As a result, a width of the pressing member 60 in the terminal arrangement direction is often enlarged. Accordingly, when the pressing member 60 is at the closed position and receives an external force having a transverse direction component toward a direction of an inside of the connector inadvertently, for example, when an excessive force is applied to the inside direction upon moving the pressing member 60 to an open position, the pressing member 60 is likely to be bent between the shaft portions to be displaced to the transverse direction. It is possible that the displacement causes the rotation center of the cam portion to move in the transverse direction and the terminal to be deformed.

In view of the problems described above, an object of the present invention is to provide an electrical connector for a flat conductive member in which a rotation center of a cam portion does not move and a terminal is not damaged at a regular position even if a pressing member at a closed position receives an external force in a transverse direction.

Further objects and advantages of the invention will be apparent from the following description of the invention.

SUMMARY OF THE INVENTION

In order to attain the objects described above, according to the present invention, an electrical connector for a flat conductive member includes a plurality of terminals formed of maintaining a plane of a metal sheet. The terminals are arranged in a plate thickness direction, so that planes of the terminals are parallel to each other. The terminal has a fixed arm portion and a movable arm portion. The fixed arm portion and the movable arm portion are provided in parallel to extend in a same direction and have arm shapes. Further, a connecting portion connects the fixed arm portion and the movable arm portion as a single member in a middle portion of a longitudinal direction.

A housing fixes and holds the fixed arm portion. The movable arm portion has a pressing portion on one end portion thereof and a pressed portion on the other end portion thereof in a longitudinal direction thereof. A pressing member is operated to move from an open position to a closed position in an operating portion.

When the pressing member moves in a specific direction, a cam portion of the pressing member moves by a specific amount to press the pressed portion of the movable arm portion to displace within a surface thereof including the plane of the terminal. The movable arm portion makes an angular movement as a lever taking the connecting portion as a pivot to displace the pressing portion due to the displacement of the pressed portion. Accordingly, a suppress force is applied to the flat conductive member in the pressing portion.

According to the present invention, the electrical connector for a flat conductive member further includes a regulating portion that is provided in the fixed arm portion of at least one of the terminal and the housing. The regulating portion regulates a movement of the pressing member at the closed position to the connecting portion side in a corresponding position of the terminal in a terminal arrangement direction or in a longitudinal direction of the flat conductive member.

In the present invention, the regulating portion is provided in the fixed arm portion of the terminal or the housing in the terminal arrangement range. The regulating portion regulates the movement of the pressing member at the closed position toward the connecting portion side of the terminal or the inside of the housing. Accordingly, even if the pressing member receives an external force toward the inside, the pressing member is not deformed or does not move in the direction. The regulating portion does not have to be provided with respect to all the terminals. Instead, it is sufficient that the regulating portion is provided in corresponding positions of some of the terminals that are arranged in the terminal arrangement direction.

According to the present invention, the regulating portion may be formed in the protruding portion. The protruding portion enters inside of a groove portion that is provided between the operating portion of the pressing member at the closed position and the cam portion. The protruding portion may be formed in the terminal or the housing.

According to the present invention, when the regulating portion is provided in the terminal, one of protruding edges of the protruding portion in a longitudinal direction of the fixed arm portion may face an inner edge of the groove portion on the operating portion side as the regulating portion. Further, the other protruding edge can form a part of the guide portion of the cam portion.

As described above, in the present invention, the regulating portion is provided in the fixed arm portion of at least one of the terminal and the housing. The regulating portion regulates the movement of the pressing member at the closed position to the connecting portion or the inside of the connector. Accordingly, even if an external force in the transverse direction toward the inside of the connector is inadvertently applied to the pressing member, the pressing member maintains the regular position and the terminal is not damaged.

BRIEF DESCRIPTION OF THE DRAWINGS

FIGS. 1(A) and 1(B) are schematic sectional views showing an electrical connector according to an embodiment of the present invention, wherein FIG. 1(A) is a schematic sectional view of the electrical connector in a state that a pressing member is at an open position, and FIG. 1(B) is a schematic sectional view of the electrical connector in a state that the pressing member is at a closed position;

FIGS. 4(A) and 4(B) are schematic sectional views showing a conventional electrical connector, wherein FIG. 4(A) is a schematic sectional view of the conventional electrical connector in a state that a pressing member is at an open position, and FIG. 4(B) is a schematic sectional view of the conventional electrical connector in a state that the pressing member is at a closed position.

DETAILED DESCRIPTION OF PREFERRED EMBODIMENTS

Figure 1:
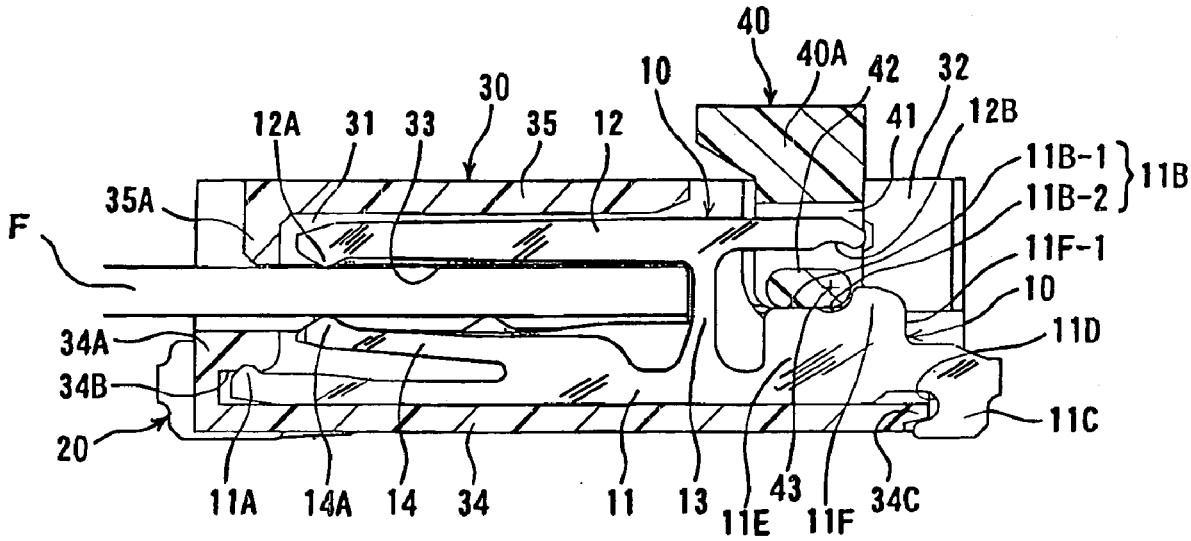
Figure 1:
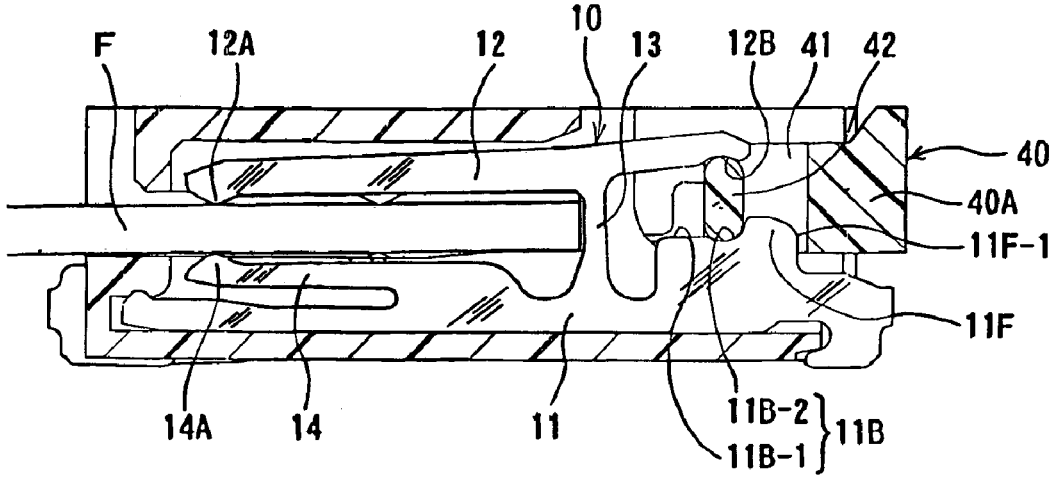

Hereunder, embodiments of the present invention will be explained with reference to the accompanying drawings.

FIGS. 1(A) and 1(B) are schematic sectional views showing an electrical connector according to an embodiment of the present invention. More specifically, FIG. 1(A) is a schematic sectional view of the electrical connector in a state that a pressing member is at an open position, and FIG. 1(B) is a schematic sectional view of the electrical connector in a state that the pressing member is at a closed position.

In the connector shown in FIGS. 1(A) and 1(B), a plurality of terminals is arranged at a specific interval in a direction perpendicular to a sheet surface. The terminal is formed of a metal sheet and has a flat surface that is parallel to the sheet surface. Two types of the terminals, terminals 10 and 20, are alternatively arranged. Features of the embodiment of the present invention are sufficiently included in at least one of the terminals, the terminal 10. Accordingly, the other type of the terminal, the terminal 20, will not be explained. Instead, only the terminal 10 is explained here.

A housing 30 has a rectangular section and extends in a direction perpendicular to the sheet surface. The housing 30 is formed of an insulation member. Receiving grooves to store the two types of the terminals are alternatively formed in the housing 30. Here, the terminal 20 will not be explained, as described above. Accordingly, an explanation of the receiving groove that corresponds to the terminal 20 will be omitted. That is, a receiving groove 31 for the terminal 10 will be explained with reference to the drawings.

The receiving groove 31 stores the terminal 10. The receiving groove 31 has an inner width (in a direction perpendicular to a sheet surface) that is commensurate with a plate thickness of the terminal 10. Further, the receiving groove 31 has a slit shape that extends in a direction parallel to the sheet surface. Moreover, the receiving groove 31 is formed to piece the housing 30 from right to left as shown in FIG. 1(A).

In a right portion of the housing 30, the receiving groove 31 for the terminal 10 and a receiving groove (not shown) for the terminal 20 are communicated in an area covering from a middle portion to an upper portion in a top-to-bottom direction to form a pressing member rotation space 32 that opens upward.

In a left half portion of the housing 30, the receiving groove 31 for the terminal 10 and the receiving groove (not shown) for the terminal 20 are communicated in a middle portion in a top-to-bottom direction to form a flat conductive member insertion space 33 that opens toward a left side. As a result, the receiving groove 31 is formed in a portion along inner surfaces of a bottom wall 34 of the housing and a top wall 35 that is situated in the left half portion of the housing inside of the housing 30.

The top wall 35 has an upper side rear edge wall 35A. A left end of the upper side rear edge wall 35A droops to a lower edge position of the receiving groove 31 on the top wall 35 and continues to a direction perpendicular to the sheet surface. Accordingly, a rear edge position of the receiving groove 31 is determined. Here, a front is a direction in which a flat conductive member F is introduced to the insertion space 33 or a right direction in the drawing, while a rear is a left direction in the drawing.

Further, the bottom wall 34 has a lower side rear edge wall 34A. A left edge of the lower side rear edge wall 34A droops to an upper edge position of the receiving groove 31 on the bottom wall 34 and has an inverted L-character shape. Further, the lower side rear edge wall 34A continues to a direction perpendicular to a sheet surface. Accordingly, a rear edge position of the receiving groove 31 is determined. Further, a fixed arm portion of the terminal 10 is pressed to fit into the inner surface thereof to form a fixed groove 34B. The fixed groove 34B fixes a position of the terminal 10. The terminal 10 will be explained later.

Further, the bottom wall 34 has a fixed edge wall 34C that has a slight taper on a front end (right end in the drawing). The terminal 10 is inserted in the receiving groove 31 from right to left as described below. On the other hand, the other terminal 20 is inserted in the receiving groove that is provided for the terminal 20 from left to right. Accordingly, the fixed groove and the fixed edge wall of the receiving groove for the terminal 20 are formed to be reversed right-to-left.

The terminal 10 is shaped of a metal sheet so that a planar surface of the metal sheet is maintained, as described above. The terminal 10 has an approximate transverse H shape as shown.

The terminal 10 includes a fixed arm portion 11, a movable arm portion 12, a connecting portion 13, and a flexible contact arm portion 14. The fixed arm portion 11 is situated in a lower portion. The movable arm portion 12 is situated above and substantially parallel to the fixed arm portion 11. The connecting portion 13 connects the fixed arm portion 11 and the movable arm portion 12 in a middle portion of the longitudinal direction thereof.

The flexible contact arm portion 14 is branched from the fixed arm portion 11 in a rear (left side) position of the connecting portion 13 and extends toward a rear portion to be substantially parallel to the fixed arm portion 11. The fixed arm portion 11, the movable arm portion 12, the connecting portion 13, and the flexible contact arm portion 14 are formed as a single member. The flexible contact arm portion 14 is situated in front of a rear end of the fixed arm portion 11 and extends only to near the lower side rear edge wall 34A.

A lower edge of the fixed arm portion 11 is supported by an inner surface of the housing bottom wall 34 in a rear (left side) portion of the connecting portion 13. Further, a locking protrusion 11A bites into an inner wall of the fixed groove 34B of the housing 30 to be fixed in a rear end of the fixed arm portion 11.

The fixed arm portion 11 has a cam supporting guide portion 11B, a connection portion 11C and a fixed groove 11D in a front (right side) portion of the connecting portion 13. The cam supporting guide portion 11B is provided for a cam portion of the pressing member. The pressing member will be explained below. The connection portion 11C protrudes outwardly from the housing 30. The fixed groove 11D is fixed to the fixed edge wall 34C of the bottom wall 34 of the housing 30.

In the embodiment, the cam supporting guide portion 11B is formed on an upper edge of a raised portion 11E of the fixed arm portion 11. The cam supporting guide portion 11B has a supporting portion 11B-1 and a guide portion 11B-2. The supporting portion 11B-1 is formed in a flat shape, while the guide portion 11B-2 is curved and recessed. A protruding portion 11F is provided on a right side of the cam supporting guide portion 11B. The protruding portion 11F is adjacent to the cam supporting guide portion 11B and faces upwardly. A left edge of the protruding portion 11F forms a part of the guide portion 11B-2, while a right edge of a protruding portion 11F forms a regulating portion 11F-1.

The connection portion 11C protrudes outwardly from the housing 30. A lower edge of the connection portion 11C is situated at a position slightly lower than that of a bottom surface of the bottom wall 34 of the housing. When the connector is arranged on a circuit board, the lower edge of the connection portion 11C is tangent to a circuit portion of the circuit board to be soldered securely.

A left edge of the connection portion 11C has a groove shape and forms the fixed groove 11D. When the terminal is inserted in the housing, the fixed groove 11D is fitted with the fixed edge wall 34C that is provided on the bottom wall 34 of the housing 30. Accordingly, the position of the fixed groove 11D is fixed.

The flexible contact arm portion 14 is branched from the fixed arm portion 11 at a rear position thereof with respect to the connecting portion 13. Further, the flexible contact arm portion 14 extends backward in parallel to the fixed arm portion 11. A contact portion 14A is formed on a distal end portion of the flexible contact arm portion 14. The contact portion 14A protrudes upwardly. Although the flexible contact arm portion 14 is mostly stored inside of the receiving groove 31 on the bottom wall 34, the contact portion 14A is situated outside of the groove and enters the flat conductive member insertion space 33.

The connecting portion 13 connects the movable arm portion 12 of the terminal 10 and the fixed arm portion 11. The movable arm portion 12 of the terminal 10 extends in a right to left direction with respect to a position of the connecting portion 13. A left end of the movable arm portion 12 is situated to correspond to the contact portion 14A of the flexible contact arm portion 14.

A pressing portion 12A is provided on the left end of the movable arm portion 12. The pressing portion 12A protrudes to face the contact portion 14A. Further, an edge that is situated to face the guide portion 11B-2 of the fixed arm portion 11 forms a recessed bent portion near a right end portion of the movable arm portion 10. The recessed bent portion forms a pressed portion 12B.

The terminal 10 is inserted in the receiving groove 31 of the housing 30 from a front edge side toward a rear side of the housing 30. The fixed arm portion 11 is stored in the receiving groove 31 of the bottom wall 34 of the housing 30. The movable arm portion 12 is stored in the receiving groove 31 of the top wall 35.

The fixed arm portion 11 contacts with the groove bottom surface of the receiving groove 31. The locking protrusion 11A of the fixed arm portion 11 bites into the fixed groove 34B of the housing 30. A lower edge of the fixed arm portion 11 is strongly pressed against a groove bottom surface of the bottom wall 34 of the housing 30 to be securely fixed due to reaction force from the fixed groove 34B.

In the embodiment, the fixed groove 11D is formed in the connection portion 11C. The fixed groove 11D is fitted with the fixed edge wall 34C on a right edge of the bottom wall 34 of the housing, thereby fixing the fixed arm portion 11 securely. A gap is formed in the movable arm portion 12 between an upper edge thereof and a lower surface of the top wall 35 of the housing 30. Accordingly, the movable arm portion 12 is elastically displaceable in a top-to-bottom direction. A portion of the movable arm portion 12 that is on a right side of the connecting portion 13 enters a pressing member rotation space 32 that does not have the top wall 35 of the housing 30.

A pressing member 40 is formed of an insulation member such as a resin. As shown in FIG. 1(A), the pressing member 40 is provided to extend outwardly from an inside of the pressing member rotation space 32 of the housing 30. Further, the pressing member 40 has a width that covers an arrangement range of the terminals 10 and 20 in a direction perpendicular to the sheet surface or a terminal arrangement direction.

A bottom half portion of the pressing member 40 is situated substantially inside of the housing 30. A groove portion 41 has a slit shape that is parallel to the sheet surface. The groove portion 41 is formed at a position that corresponds to that of the terminal 10 in the arrangement direction in the bottom half portion of the pressing member 40. The groove portion 41 allows the movable arm portion 12 of the terminal 10 to pass through. Further, a top half portion of the pressing member 40 is situated outside of the housing 30 and forms an operating portion 40A.

The groove portion 41 is provided with a cam portion 42 at the edge portion position of the pressing member 40 (a lower edge position shown in FIG. 1(A)). The cam portion 42 connects inner wall faces (the inner wall faces facing each other in the arrangement direction) of the groove 41. The cam portion 42 has a section having a horizontally long oval shape when the pressing member 40 is at an open position as shown in FIG. 1(A).

As shown in FIG. 1(A), a distance from a left edge to a right edge of the cam portion 42 is larger than a distance between the cam supporting guide portion 11B and the pressed portion 12B. The cam portion 42 has a common rotation axis line in a center 43 that is situated on a right side of the semicircle portion shown in FIG. 1(A). The rotation axis line extends in a direction perpendicular to a sheet surface.

The pressing member 40 is rotated from the open position shown in FIG. 1(A) to the closed position shown in FIG. 1(B) around the center 43. The protruding portion 11F of the terminal 10 enters the groove portion 41 when the pressing member 40 is at the closed position. A right edge of the protruding portion 11F or the regulating portion 11F-1 is situated to be adjacent to a groove bottom portion of the groove portion 41 of the pressing member 40.

When the pressing member 40 is rotated to the closed position shown in FIG. 1(B), the pressed portion 12B of the terminal 10 receives pressure from the cam portion 42 and is elastically displaced upwardly according to the cam displacement amount, which causes a downward elastic displacement of the pressing portion 12A because the movable arm portion 12 leans as a lever to be displaced taking the connecting portion 13 as a pivot.

The connector of the embodiment described above is used as follows.

(1) First, as shown in FIG. 1(A), an end portion of the flat conductive member F or a connection circuit portion is inserted in the flat conductive member insertion space 33 frontward. The flat conductive member insertion space 33 is formed in the left portion of the housing 30. At this time, a surface of the connection circuit is situated on a lower surface side to face the contact portion 14A of the terminals 10.

(2) After the flat conductive member is brought to a specific position, or more specifically, after the flat conductive member is inserted to a depth in which a distal portion thereof is adjacent to an adjacent portion of the housing 30, the pressing member 40 is rotated clockwise toward the closed position shown in FIG. 1(B).

When the pressing member 40 is brought to the closed position, the cam portion 42 rotates around the center 43 to become a vertically elongated posture. The cam portion 42 presses the pressed portion 12B of the terminal 10 and is displaced upward. When the pressing member 40 is brought to the closed position shown in FIG. 1(B), the protruding portion 11F of the fixed arm portion 11 of the terminal 10 enters the groove 41 between the operating portion 40A of the pressing member 40 and the cam portion 42. Accordingly, the right edge of the protruding portion 11F or the regulating portion 11F-1 becomes adjacent to and faces the bottom portion of the groove 41.

(3) The movable arm portion 12 of the terminal 10 leans as a lever taking the connecting portion 13 as a pivot due to the displacement of the pressed portion 12B of the terminal 10. As a result, the pressing portion 12A is elastically displaced downward. Accordingly, the pressing portion 12A of the terminal 10 brings the flat conductive member F into contact with the contact portion 14A of the terminal 10 with specific contact pressure. The pressing portion of the terminal 20 presses the flat conductive member to contact the contact portion with contact pressure due to the rotation of the pressing member 40.

(4) Accordingly, even when the pressing member 40 receives a force toward the rear portion thereof or an inside of the housing 30 in the transverse direction when the pressing member 40 is at the closed position and the flat conductive member F and the terminal 10 are electrically connected, the bottom portion of the groove portion 41 of the pressing member 40 is situated adjacent to the regulating portion 11F-1 and does not practically move. Accordingly, the pressing member 40 is prevented from being deformed or coming off.

The present invention is not limited to the embodiment shown in FIG. 1, and can be modified. For example, the regulating portion does not have to be formed as the protruding portion that enters the groove portion of the pressing member at the closed position.

Figure 2:
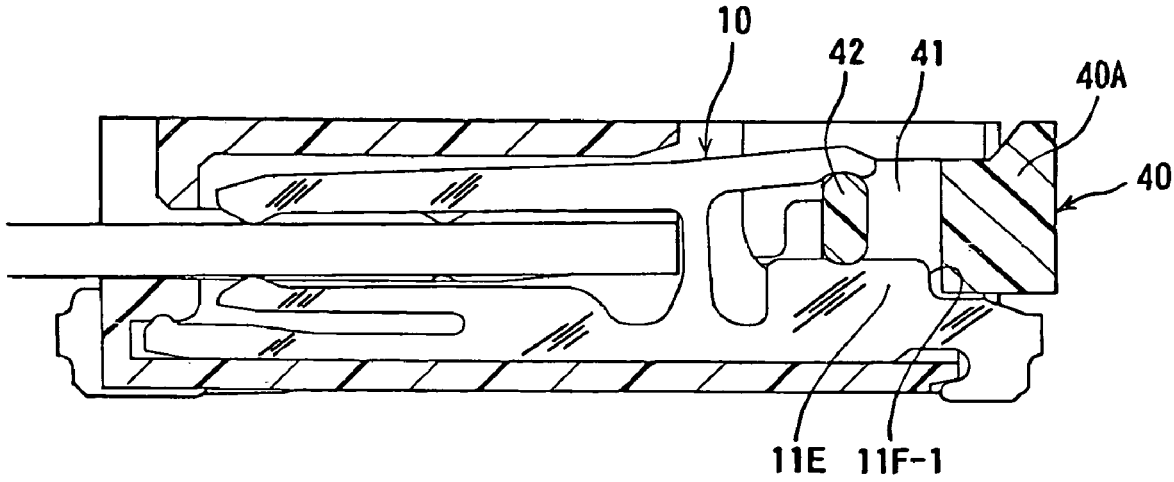
FIG. 2 is a schematic sectional view showing an electrical connector according to another embodiment of the present invention.

FIG. 2 is a schematic sectional view showing an electrical connector according to another embodiment of the present invention. As shown in FIG. 2, the operating portion 40A of the pressing member 40 can droop to a position along a side of the raised portion 11E of the terminal 10 when the pressing member 40 is at the closed position. Accordingly, a right edge of the raised portion 11E faces a left surface (a surface of a position that corresponds to a bottom of the groove portion) of the operating portion 40A as the regulating portion 11F-1.

Figure 3:
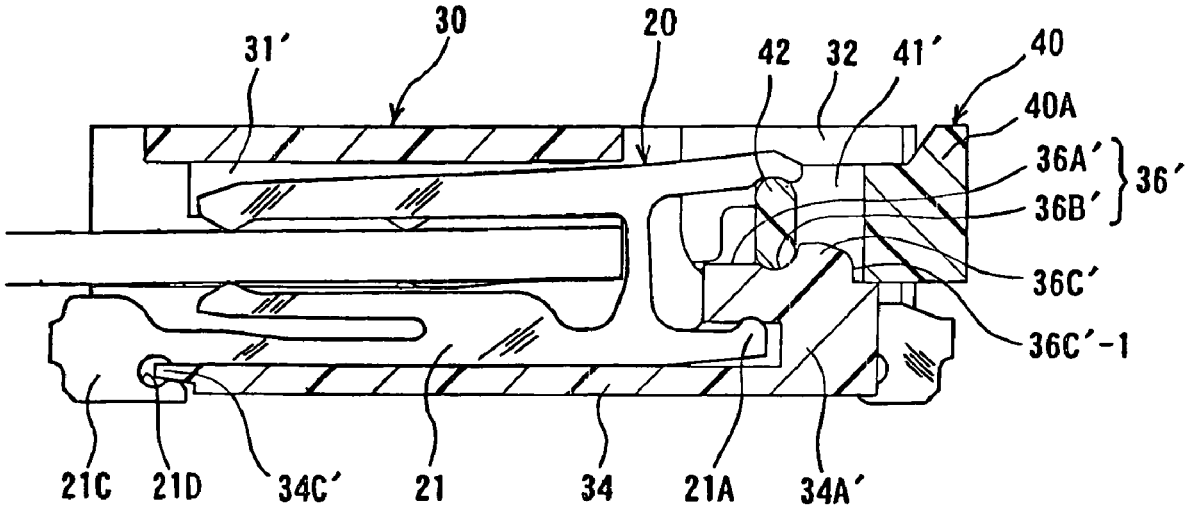
FIG. 3 is a schematic sectional view showing an electrical connector according to a further embodiment of the present invention.

The regulating portion can be formed in the housing instead of the terminal. FIG. 3 is a schematic sectional view showing an electrical connector according to a further embodiment of the present invention.

In the embodiment shown in FIG. 3, the terminal 20 is inserted in the housing from a direction that is opposite to the direction of the terminal 10 shown in FIG. 1. Accordingly, the terminal 20 can be considered to be the other terminal that is arranged between the terminals 10 in the embodiment shown in FIG. 1.

In the embodiment, the terminal 20 is inserted in a corresponding receiving groove 31' from an opposite direction of the terminal 10. Accordingly, a fixed arm portion 21 of the terminal 20 is formed to have a reversed shape relative to that of the fixed arm portion 11 of the terminal 10. That is, the terminal 20 is provided with a locking protruding portion 21A in a front edge portion (right edge portion) of the fixed arm portion 21. Further, the terminal 20 is provided with a connection portion 21C and a fixed groove 21D in a rear edge portion (left edge portion).

The housing 30 has a fixed edge wall 34C' on a rear edge of the bottom wall 34. The fixed groove 21D of the terminal 20 is fitted into the fixed edge wall 34C'. Further, the housing 30 has a lower side front edge wall 34A' in a lower portion of the pressing member rotation space 32. The locking protruding portion 21A of the fixed arm portion 21 is pressed to fit into and locked in the lower side front edge wall 34A'.

A cam supporting guide portion 36' is formed on a top face of the lower side front edge wall 34A'. The cam supporting guide portion 36' comprises a supporting portion 36A' and a guide portion 36B'. A protruding portion 36C' forms a part of the cam supporting guide portion 36B'. The protruding portion 36C' is formed to enter a groove portion 41' of the pressing member 40. A right edge of the protruding portion 36C' is adjacent to face a bottom portion of the groove portion 41' of the pressing member 40 at a closed position to form a regulating portion 36C'-1.

The disclosure of Japanese Patent Application No. 2007-154690, filed on Jun. 12, 2007 is incorporated in the application by reference.

While the invention has been explained with reference to the specific embodiments of the invention, the explanation is illustrative and the invention is limited only by the appended claims.

What is claimed is:

1. An electrical connector to be connected to a flat conductive member, comprising:

a housing;

a terminal disposed in the housing, said terminal including a fixed arm portion, a movable arm portion, and a connecting portion connecting the fixed arm portion and the movable arm portion, said movable arm portion including a pressing portion on one end portion thereof and a pressed portion on the other end portion thereof;

a pressing member disposed to be movable between an open position to a closed position for pressing the pressed portion, said pressing member including an operating portion and a cam portion so that a groove portion is formed between the operating portion and the cam portion, said operating portion having a first surface facing the cam portion and being vertical when the pressing member is situated at the closed position; and a regulating portion disposed on at least one of the housing and the fixed arm portion for regulating the pressing member at the closed position from moving toward the connecting portion, said regulating portion having a second surface extending in a direction perpendicular to a direction that the flat conductive member is inserted into the electrical connector, said regulating portion being accommodated in the groove portion when the pressing member is situated at the closed position so that the first surface faces the second surface.

2. The electrical connector according to claim 1, wherein said terminal includes a plurality of terminal sections arranged in the housing.

3. The electrical connector according to claim 1, wherein said terminal is formed in a plate shape.

4. The electrical connector according to claim 1, wherein said pressing member includes a cam portion for pressing the pressed portion so that the movable arm portion moves with the connecting portion as a pivot and the pressing portion presses the flat conductive member.

5. The electrical connector according to claim 1, wherein said regulating portion is formed on a protruding portion protruding into a groove portion of the pressing member formed between an operating portion and a cam portion of the pressing member.

6. The electrical connector according to claim 1, wherein said protruding portion includes a first edge and a second edge, said first edge as the regulating portion facing an inner surface of the groove portion on a side of the operating portion, said second edge forming a part of a guide portion relative to the cam portion.

7. The electrical connector according to claim 1, wherein said regulating portion is arranged to be in the groove portion when the pressing member is situated at the closed position so that the first surface extends in parallel to the second surface.

* * * * *